US005607012A

United States Patent [19]

Buchanan et al.

[11] Patent Number: 5,607,012

[45] Date of Patent: Mar. 4, 1997

[54] HEAT EXCHANGER

[75] Inventors: William J. Buchanan, Olcott; Siegfried A. Wasse, Grand Island; Thomas A. Bowler, Lockport, all of N.Y.

[73] Assignee: General Motors Corporation, Detroit, Mich.

[21] Appl. No.: 489,508

[22] Filed: Jun. 12, 1995

[51] Int. Cl.[6] ..... F28F 9/02

[52] U.S. Cl. ..... 165/173; 165/DIG. 482; 165/176

[58] Field of Search ..... 165/153, 110, 165/174, 176, 173

[56] References Cited

U.S. PATENT DOCUMENTS

| | | | |
|---|---|---|---|
| 4,825,941 | 5/1989 | Hoshino et al. | 165/110 |
| 5,062,476 | 11/1991 | Ryan et al. | 165/173 |
| 5,119,552 | 6/1992 | Sutou et al. | 29/890.052 |
| 5,125,454 | 6/1992 | Creamer et al. | 165/173 |
| 5,127,466 | 7/1992 | Ando | 165/67 |
| 5,297,624 | 3/1994 | Haussmann et al. | 165/173 |
| 5,329,995 | 7/1994 | Dey et al. | 165/153 |
| 5,341,872 | 8/1994 | Mercurio | 165/173 |

FOREIGN PATENT DOCUMENTS

| | | |
|---|---|---|
| 138435 | 9/1984 | European Pat. Off. . |
| 450619 | 4/1991 | European Pat. Off. . |

*Primary Examiner*—Allen J. Flanigan
*Attorney, Agent, or Firm*—Patrick M. Griffin

[57] ABSTRACT

An automotive condenser (10) includes spaced manifold assemblies (18) comprised of semicylindrical tanks (20), matching semicylindrical headers (22) and simple, circular disks (38) serving as manifold separators. The disks (38) are sandwiched between the tank (20) and header (22) with no need for orientation, and with no slots or through notches to pierce the surface of the tank (20) or header (22). The disks (38) sit within matching pairs of common diameter grooves (30, 36) which provide complete, continuous pockets therefore.

2 Claims, 3 Drawing Sheets

HEAT EXCHANGER

This invention relates to heat exchangers in general and specifically to an improved design for the header and tank assembly of a heat exchanger.

BACKGROUND OF THE INVENTION

Automotive air conditioning systems use a heat exchanger called a condenser that cools the compressed system refrigerant, and which experiences high pressures. To resist such pressures, it has been known for decades to use cylindrical tubes as the main structural component for the condenser, both for the flow tubes that carry the cooling refrigerant and for the manifolds that inlet flow to and outlet it from the flow tubes. This venerable design has come to be called a tube and fin condenser, and was a preferred design for a long time, both because of its structural simplicity and ability to easily withstand internal pressures of ten atmospheres or more. An improvement to this basic design, shown in co-assigned European Patent 0138435, involved the use of axially inserted plugs, sometimes referred to as separators or baffles, within the cylindrical manifolds to segregate the flow tubes into multiple passes. This improves thermal efficiency while leaving the manifolds uninterrupted at any point along their length, apart from the flow tube slots. Only the ends of the tanks, and the flow tube to tank interfaces, needed to be sealed. Such a design would be difficult to scale up to larger diameters, however, as it would be difficult to axially insert a larger diameter plug deep into a long cylinder without cocking or deformation.

While representing the simplest design, cylindrical tubes were not the most thermally efficient flow tube design, nor were cylindrical tanks the most spatially efficient manifold shape, despite their obvious high internal pressure resistance. Flat flow tubes were known to be more thermally efficient, since they present more surface area to be cooled for a given internal volume and, with suitable internal webbing, could be made sufficiently resistant to internal pressures. Flat tubes cannot be practically bent around into the hair pin shape often found in tube and fin condensers, however, so the manifold tanks are simply placed at opposite sides of the heat exchanger, as in a typical radiator. Likewise, manifold tanks with a rectangular cross section were known to be more space efficient, for the same reason that rectangular boxes stack more efficiently on a shelf than do cylindrical cans of a comparable size. Furthermore, by making such a rectangular cross section tank from a three sided extruded unit enclosed by a stamped and slotted tube header, and by providing sufficient material thickness and adequate brazing seams, enough internal pressure resistance could be provided. A two piece, brazed manifold assembly also provides the capability of stamping shallow separator grooves into the inner surfaces of the two pieces and accurately and easily inserting flow pass separators as the two pieces are assembled together. An example of such a condenser incorporating all of these features may be seen in co-assigned U.S. Pat. No. 5,062,476.

Despite the availability of rectangular tank designs with easy to install separators, designers have continued to work on designs that incorporate cylindrical (or nearly cylindrical) manifolds, while retaining the flat flow tubes, because of the inherently better pressure resistance (for a given material thickness and weight) that a cylindrical pressure vessel gives. Two design directions have been followed, one piece cylindrical tubes with plugged ends and two piece cylindrical manifold assemblies. One piece cylindrical manifolds simply scale up the diameter of a tube and fin condenser manifold, but face the difficulty of how to install the necessarily larger flow pass separators, as noted above. Since the larger flow pass separators cannot be simply axially rammed into place, they are typically inserted radially into the back of the tank through slots. An example may be seen in U.S. Pat. No. 4,825,941. This presents the real disadvantage of creating another potential leak path through the surface of the tank. Another problem is that the separator cannot be a simple circle, but must have a step in its outer edge in order be able to both seal against the inner surface of the tank and fill the slot in the back of the tank. Not being a simple circle, the separator has to be properly oriented during installation. A later design with a one piece cylindrical tank, U.S. Pat. No. 5,348,083, notes this deficiency, and does provide a separator that is a simple circle. However, the slot in the back of the tank must be more complex, including a pair of side barbs that are initially straight, and which are then bent in and around the circular separator after it is inserted. This adds an additional assembly step, and still represents a potential leak path.

Two piece cylindrical manifold assemblies, of which there are numerous examples, are basically the cylindrical structural equivalent of the two piece rectangular tank design noted above, with all the same inherent assembly advantages, but with the potential for greater pressure resistance for a given material thickness. Known two piece cylindrical tank designs have not, however, provided a simple separator or baffle design. U.S. Pat. No. 5,125,454 shows a separator that is not only very complex in shape, with numerous steps and notches, but which also, despite the two piece design, is inserted from the back through a separate slot, combining the worst features of one and two piece designs. U.S. Pat. No. 5,127,466 shows a two piece design in which one half cylinder slide fits down lengthwise into heavy, continuous internal flanges within the other half cylinder. While the design does not disclose separators per se, they would have to be of a notched or stepped design, as well, because of the internal discontinuity created by the extruded internal flanges. U.S. Pat. No. 5,036,914 shows a two piece manifold design with at least some embodiments that are free of internal discontinuities, though these embodiments do not have a circular cross section. Again, separators are not disclosed per se. The design intent for the separators can instead be seen in published European application EP-450-619-A, which has the same assignee, in FIGS. 8 and 9. The separators also have locating notches that pierce both the header and the tank. There appears to be a near consensus in the art, therefore, that separators in two piece cylindrical manifolds should have locating notches that pierce the wall of one or both pieces of the manifold. An exception is U.S. Pat. No. 5,341,872, which avoids separator locating notches by instead incorporating an additional component in the form of an internal locating rail that holds the separators. Besides the additional expense and bother of a separate component, the separators disclosed are still not simple circular disks, but also have notches that interfit with the locating rail, and which would require careful orientation at installation.

SUMMARY OF THE INVENTION

A heat exchanger in accordance with the present invention is characterized by the features specified in Claim 1. Specifically, the invention provides what the various known designs described above fail to provide, a two piece, manifold assembly of circular internal cross section in which simple, circular separators may be installed in any orientation and location, and without piercing or jeopardizing the seal of either the header or tank.

In the embodiment disclosed, an automotive air conditioning system condenser includes two spaced manifold assemblies, each comprised of a semi cylindrical tank and semi cylindrical header that mate along their longitudinal edges. The mating inner surfaces of each tank and header pair lie on substantially a common circle, and each mating inner surface has at least one pair of matching grooves formed therein which lie exactly on a common circle. The matching pairs of grooves allow a separator in the form of a simple circular disk to be installed therein, sandwiched between the tank and header, before the two are joined and brazed together. The uniform, simple separators can be installed in any location and orientation, with no slots or notches to create potential leak paths. Preferably, all components may be made of suitable, brazable aluminum alloy, and produced as simple extrusions and stampings.

DESCRIPTION OF THE PREFERRED EMBODIMENT

The invention will now be described with reference to the following drawings, in which.

Figure 1:
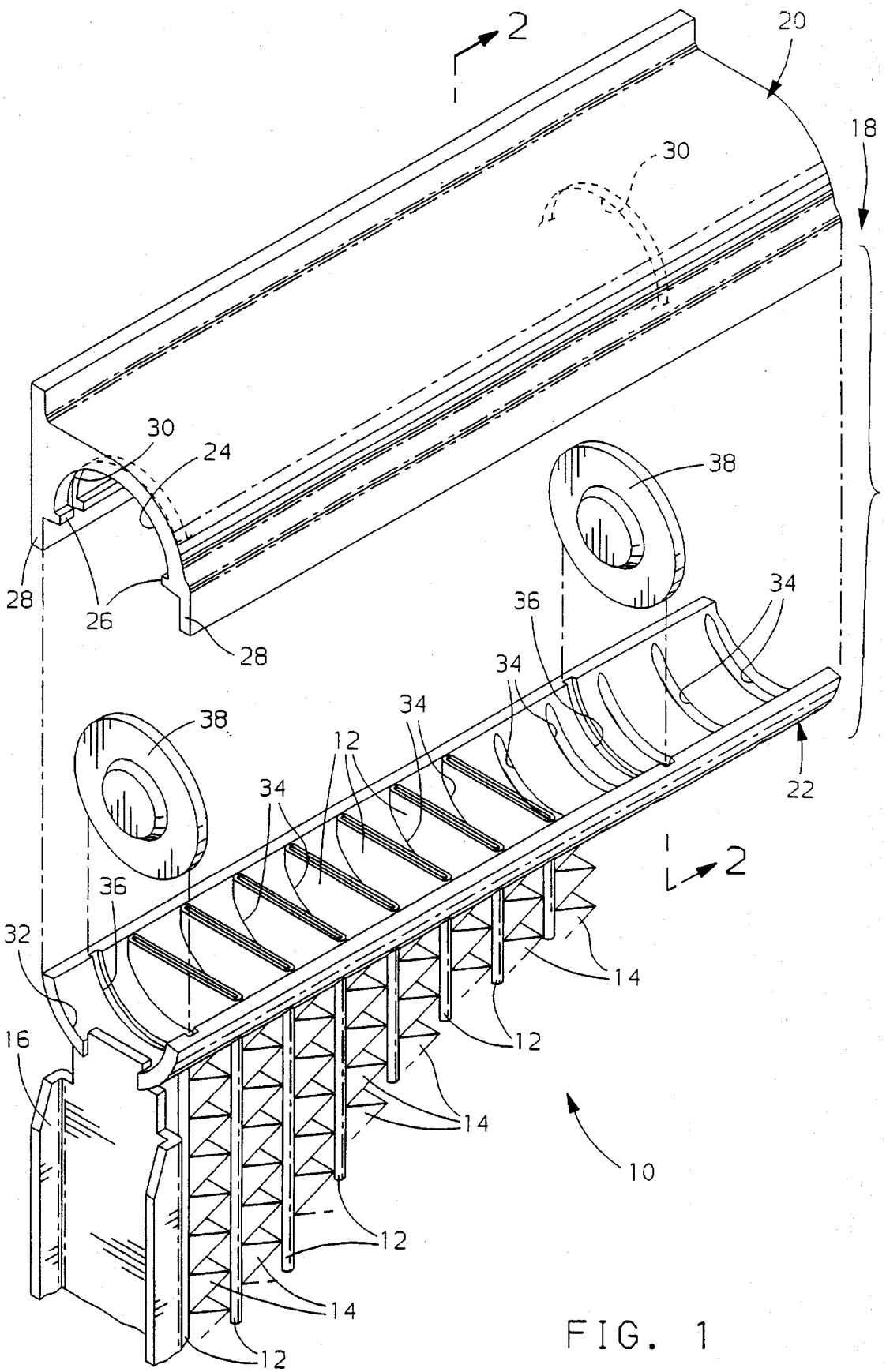
FIG. 1 is a perspective view illustrating the ends of some of the flow tubes and interleaved cooling fins, with the header and tank exploded apart, and with two separators disassembled.
Figure 2:
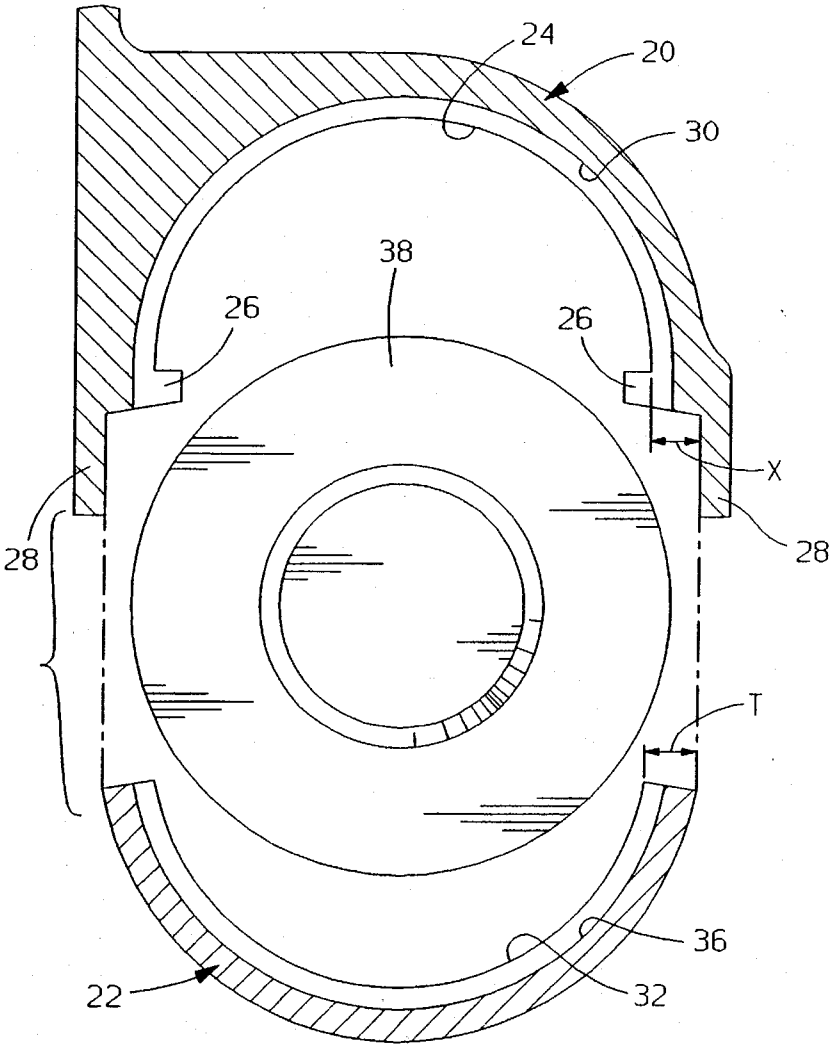
FIG. 2 is a cross section taken though the tank and header matching grooves in the plane represented at 2—2 in FIG. 1, but showing the separator in elevation.
Figure 5:
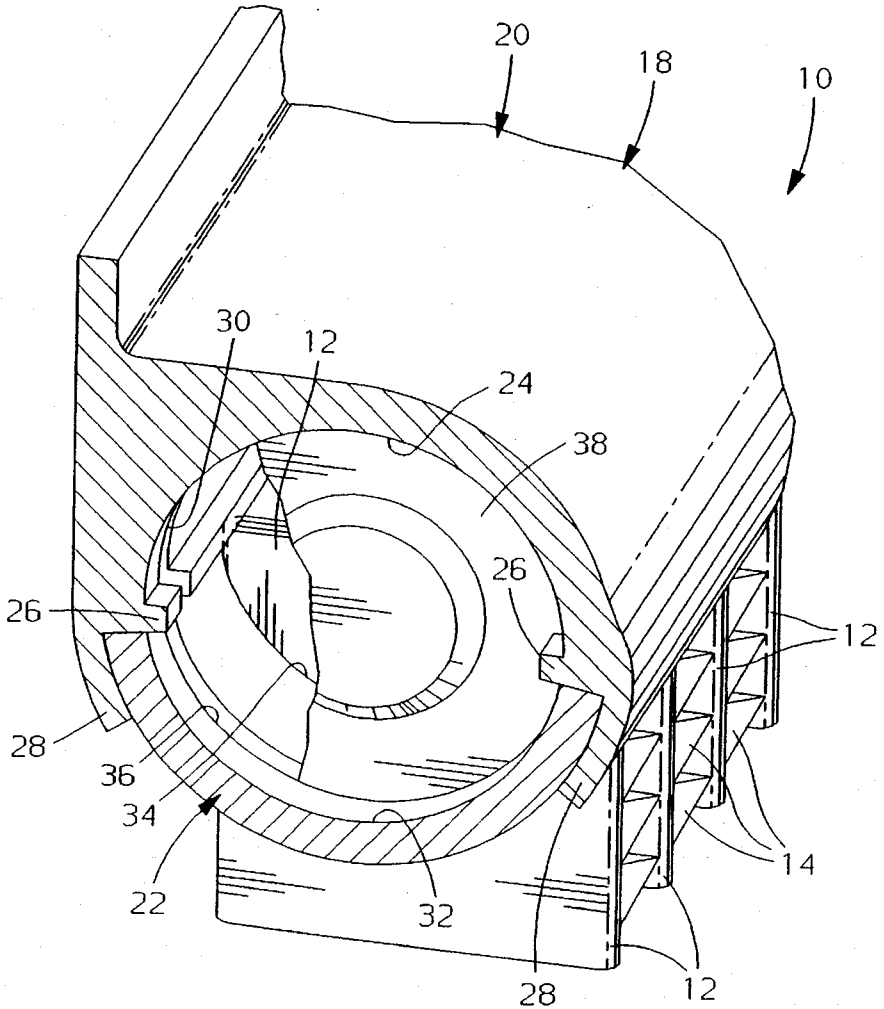
FIG. 5 is a perspective view corresponding to FIG. 4, and showing the separator partially broken away to reveal the inside of the completed manifold assembly.

Referring first to FIGS. 1, 2 and 5, a preferred embodiment of a heat exchanger made according to the invention, being a condenser indicated generally at 10, includes a central core comprised of a plurality of flat flow tubes 12 brazed to the peaks of intermediate corrugated cooling fins 14. Side rails 16 protect the top and bottom tubes 12, and have their ends fixed to corresponding ends of a spaced pair of manifold assemblies, indicated generally at 18. This creates a basic four sided structural frame surrounding the flow tubes 12. Each manifold assembly 18 is basically an elongated cylinder, comprised of two half cylinders, a tank, indicated generally at 20, and header indicated generally at 22. Preferably, each tank 20 is an extruded aluminum part, with an inner surface 24 that lies on a cylindrical surface, departing therefrom only at a pair of radially inwardly projecting shelves 26 at the outer edges thereof. Shelves 26 serve a purpose described below. The outer surface of tank 20 may depart from a cylindrical surface wherever desired, most notably where a pair of initially flat longitudinal flanges 28 are offset outwardly from the tank inner surface 24 by a distance indicated at X. The shelves 26 and flanges 28 form a comer that is slightly obtuse, because of the fact that the tank inner surface 24 subtends a total angle that is slightly more than a half circle. At several axially spaced locations, a semi circular groove 30 is formed into tank inner surface 24, but only partially thereinto, and also locally through the shelves 26. At least two such grooves 30 would be formed, near the ends of tank 20, and as many other intermediate grooves 30 as needed to form the number of flow passes desired. Each header 22 is a simple semi cylindrical stamping, with a thickness T roughly equal to X and an inner surface 32 that substantially matches the diameter of tank inner surface 24. Edge to edge, header 22 subtends the remainder of a complete circle not covered by tank 20, being just under a half circle here. Preferably, header 22 is stamped from aluminum clad on both sides with a suitable braze layer. Header 22 is slotted regularly at 34, to receive the ends of the flow tubes 12. The header inner surface 32 is also formed with the same number of semi cylindrical grooves 36 as is tank 20, and at the same axial locations, and of equal diameter. The remaining components comprise a number of simple, circular disks 38, stamped from the same material as header 22, which serve as separators or baffles. Each identical disk 38 has a diameter and axial thickness nearly equal to that of the grooves 30 and 36.

Figure 3:
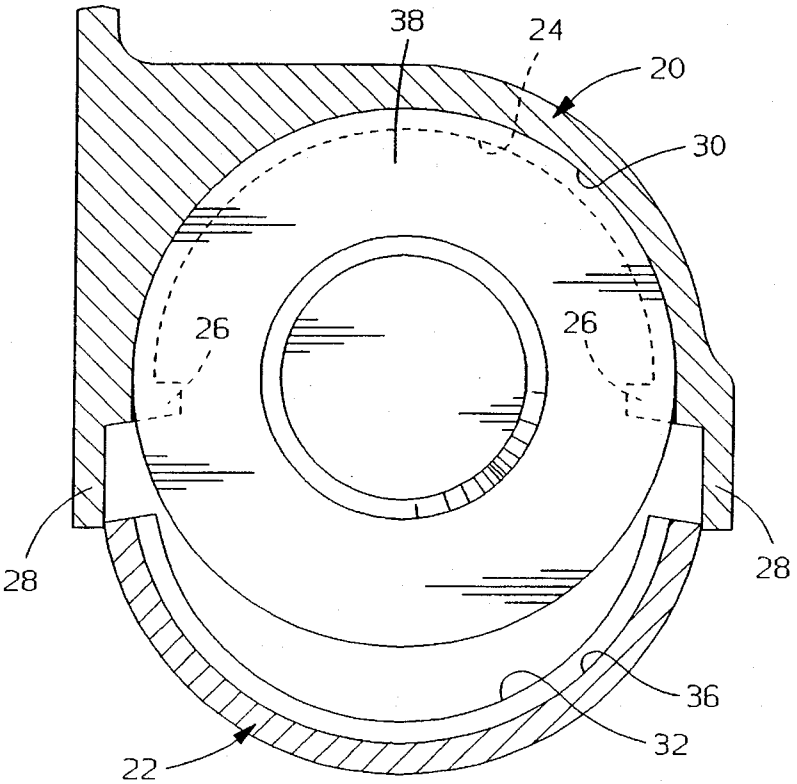
FIG. 3 is a view like FIG. 2, but showing the header closer to the tank.
Figure 4:
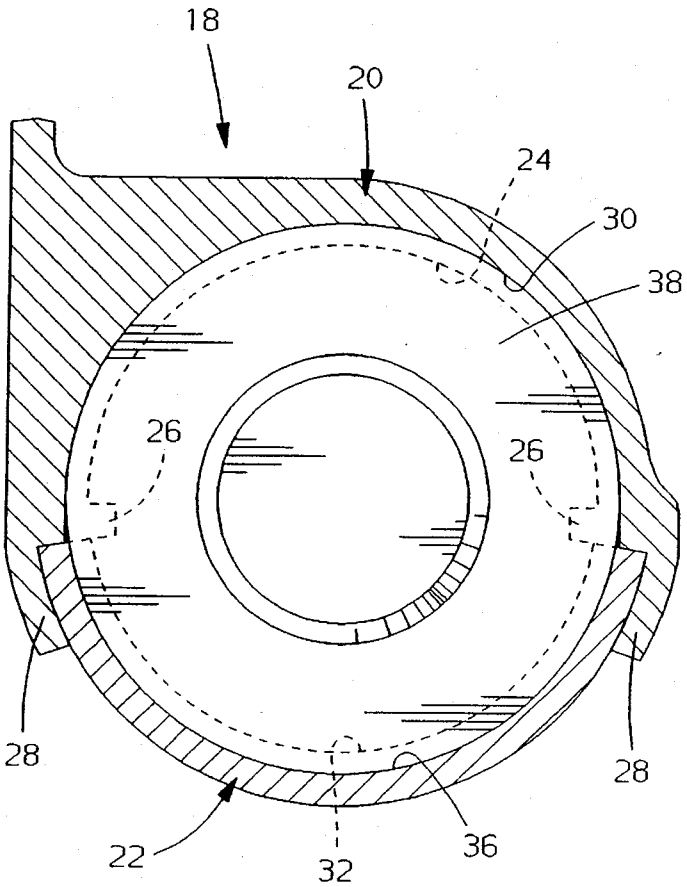
FIG. 4 shows the header mated with and joined to the tank, with the separator captured in place.

Referring next to FIGS. 2 through 4, the installation of the disks 38 within of manifold assembly 18 is illustrated. Since the grooves 30 and 36 have exactly the same diameter, axial thickness, and axial location, they align in matching pairs, lying on a common circle, when the header 22 and tank 20 are aligned. A disk 38 is simply set into the grooves 30 or 36 of either tank 20 or header 22, without deliberate orientation. Then, the aligned header 22 and tank 20 may be simply pushed straight toward one another until the longitudinal edges of header 22 abut the tank shelves 26, inboard of the flanges 28. The disks 38 are automatically captured and held within the aligned groove pairs 30, 36. Regardless of whether the respective inner surfaces 24 and 32 lie on exactly the same circle, the fact that the matching groove pairs 30 and 36 do lie on the same circle, and extend partially into and all the way across both of the respective inner surfaces 24 and 32, provides a complete and continuous pocket for a disk 38. Then, the flanges 28 are bent in and partially around the outer surface of header 22, crimping the two together. Since the flanges 28 do not have to be bent severely, a simple roller mechanism would suffice. The separator disks 38 are completely captured within the matching pairs of grooves 30 and 36. It will be appreciated that each disk 38 may be installed into any pair of grooves 30 and 36, and in any orientation, simplifying the assembly task greatly. Once the subassembly of header 22 and tank 20 is complete, the tubes 12, fins 14 and side rails 16 are held in a suitable stacker and the ends of tubes 12 are inserted into the header slots 34. Finally, the entire unit is run though a conventional braze oven. Braze material from the fins 14, header 22 and disks 38 melts and runs into all intra part interfaces, eventually solidifying to form leak proof seams. Specifically, the edges of the disks 38 sit within the matching pairs of grooves 30 and 36 with a slight clearance, which draws in melted braze material by capillary action, providing a complete seam all the way round.

In the completed condenser 10, shown in FIG. 5, the end most disks 38 seal the ends of the completed pair of spaced manifold assemblies 18, creating a complete, strong cylindrical pressure vessel. The integrity of the seams around the end most disks 38 may be easily visually checked. The intermediate disks 38 provide separate flow passes segregating specific groupings of flow tubes 12. While the seams around the intermediate disks 38 cannot be visually checked, as with the end disks 38, a small crevice in their seams would not adversely affect operation of the condenser 10 significantly. And, since no part of the disks 38 protrudes through the outer surfaces of either the header 22 or tank 20, any discontinuities in their braze seams would not jeopardize the overall seal of the pressure vessel. In conclusion, a manifold assembly 18 of high pressure resistance optimized simplicity of manufacture and assembly is provided, with a minimal amount of potential leak path from the assembly.

We claim:

1. A heat exchanger (10) of the type having a manifold assembly (18) comprised of a semi cylindrical tank (20) and interfitting semi cylindrical flow tube header (22), characterized in that the inner surfaces (24, 32) of said tank (20) and tube header (22) lie substantially on a common circle, said header (22) having longitudinal edges with a thickness substantially equal to the thickness of said header (22), said tank (20) having a pair of longitudinal flanges (28) offset from its inner surface (24) along inwardly projecting shelves (26) by substantially the thickness of said header (22), said flanges (28) being bent partially around the outer surface of said header (22) to abut the longitudinal edges of said header (22) with said shelves and with each of said inner surfaces (24, 32) having a matching groove (30, 36) formed therein lying on a common circle and extending only partially into said respective inner surfaces (24, 32), and with each of said pairs of matching grooves (30, 36) providing a complete and continuous pocket containing a circular separator (38) having flat edges that divides said manifold assembly (18) into discrete flow pass sections, whereby each of said manifold assemblies (18) provides a cylindrical pressure vessel with each of said separators (38) being capable of installation in any pair of grooves (30, 36), and in any orientation, while leaving said tank (20) and header (22) uninterrupted.

2. A heat exchanger (10) according to claim 1 and further characterized in that the tank (20) and header (22) each subtend, in cross section, an approximate half circle.

* * * * *